US006857736B2

(12) United States Patent
Onishi et al.

(10) Patent No.: US 6,857,736 B2
(45) Date of Patent: Feb. 22, 2005

(54) INK JET RECORDED MATTER AND PRODUCTION PROCESS THEREFOR, AND THERMAL TRANSFER SHEET, INK JET RECORDING APPARATUS, THERMAL TRANSFER APPARATUS, AND INK JET RECORDING MEDIUM

(75) Inventors: Hiroyuki Onishi, Nagano (JP); Hajime Mizutani, Nagano (JP); Teruaki Kaieda, Nagano (JP); Katsumori Takei, Nagano (JP); Masahiro Hanmura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/281,908

(22) Filed: Oct. 28, 2002

(65) Prior Publication Data

US 2003/0174195 A1 Sep. 18, 2003

Related U.S. Application Data

(63) Continuation-in-part of application No. 10/215,366, filed on Aug. 8, 2002.

(30) Foreign Application Priority Data

| | | |
|---|---|---|
| Aug. 10, 2001 | (JP) | P.2001-244903 |
| Oct. 23, 2001 | (JP) | P.2001-325636 |
| Oct. 29, 2001 | (JP) | P.2001-331112 |
| May 7, 2002 | (JP) | P.2002-131965 |
| Aug. 7, 2002 | (JP) | P.2002-230294 |

(51) Int. Cl.[7] ..... B41J 2/01
(52) U.S. Cl. ..... 347/105
(58) Field of Search ..... 347/101, 102, 347/104–106; 427/429; 430/619, 531

(56) References Cited

U.S. PATENT DOCUMENTS

| | | | | |
|---|---|---|---|---|
| 5,824,462 | A * | 10/1998 | Ashida et al. | 430/531 |
| 6,093,529 | A * | 7/2000 | Tsuzuki et al. | 430/619 |
| 2002/0027586 | A1 * | 3/2002 | Kikuchi et al. | 347/104 |
| 2003/0054113 | A1 * | 3/2003 | Suzuki et al. | 427/429 |

FOREIGN PATENT DOCUMENTS

| | | |
|---|---|---|
| JP | 60-23096 | 2/1985 |
| JP | 60-189486 | 9/1985 |
| JP | 08-174989 | 7/1986 |
| JP | 61-230973 | 10/1986 |

* cited by examiner

*Primary Examiner*—K. Feggins
(74) *Attorney, Agent, or Firm*—Ladas & Parry LLP

(57) ABSTRACT

On ink jet recorded matter comprising an ink jet recording medium having a substrate and an ink receiving layer formed thereon containing porous inorganic particles and an image formed with a pigment ink on the ink receiving layer, a protective layer covering the image is formed by thermally transferring a transfer layer from a heat-resistant carrier onto the image. The ink jet recording medium comprises a substrate and an ink receiving layer formed on one side of the substrate, wherein an ink jet recorded image and a protective layer covering the image are to be formed on the surface of the ink receiving layer, said side of the substrate, before the formation of the ink receiving layer, having a Bekk's surface smoothness of 200 seconds or higher and the surface of the ink receiving layer having a Bekk's surface smoothness of 60 seconds or higher. Also disclosed is an ink jet recording medium having no ink receiving layer, which comprises a substrate treated with a solution of a metal salt and in which the front and back sides of the substrate each have a Bekk's surface smoothness of 200 seconds or higher.

34 Claims, 2 Drawing Sheets

INK JET RECORDED MATTER AND PRODUCTION PROCESS THEREFOR, AND THERMAL TRANSFER SHEET, INK JET RECORDING APPARATUS, THERMAL TRANSFER APPARATUS, AND INK JET RECORDING MEDIUM

This application is a continuation in part of Ser. No. 10/215,366 filed Aug. 8, 2002.

BACKGROUND OF THE INVENTION

1. Field of the Invention

This invention relates to ink jet recorded matter having a pigment ink image formed on a porous ink receiving layer, a process for producing the same, and a thermal transfer sheet, an ink jet recording apparatus, a thermal transfer apparatus, and an ink jet recording medium, which can be used in the production process.

2. Description of Related Art

Ink jet recording is an image recording technology in which ink droplets ejected from small nozzles of a recording head are adhered to a recording medium such as paper to form an ink image. Formation of high quality images, comparable to silver salt photographs, by ink jet recording needs large quantities of ink so that recording media used therefor are required to have high ink receptivity. Use of a plurality of ink formulations equal in hue but different in colorant concentration has recently been spreading to form high quality images with reduced graininess in highlights, and the demand for ink receptivity of recording media has been increasing with this trend. To meet the demand, recording media for ink jet recording, which exhibit high ink absorptivity and which are capable of forming high quality full color images comparable to silver salt photographs have been developed. The recording media of this type comprise a substrate, such as paper or a film, having thereon provided a porous ink receiving layer made mainly of ultrafine particles of inorganic pigments, such as colloidal silica, vapor phase deposited silica, alumina hydrate and γ-alumina.

Aqueous inks are generally used in ink jet recording, which are solutions or dispersion of colorants including dyes and pigments in aqueous media such as water and alcohol-containing water. These inks are largely classified into dye inks and pigment inks. Dye inks have been in frequent use for their high color reproducibility, high water solubility and other advantages over pigment inks. However, dye ink images formed on a porous ink receiving layer have poor fastness and are liable to discoloration and fading with time by the influences of water, moisture, ozone gas, etc. Considering that ink jet recorded image fastness has been gaining importance with broadening applications of ink jet recording technology to digital photography and commercial printing, improvement in image fastness has now come to be an important subject in the ink jet recording art. Hence, use of pigment inks which are superior to dye inks in image fastness to light, water, etc. has been increasing.

Nevertheless images formed of pigment inks is disadvantageous in that a pigment, which merely adheres onto the surface of a recording medium, has poor scratch resistance and easily comes off. Images formed of pigment inks have another problem of gloss unevenness between image areas and non-image areas and among image areas with different attached amounts of pigment. Further, pigment images formed on a porous ink receiving layer, while superior in fastness to those formed of dye inks, can undergo discoloration and fading with time due to ozone gas, heat, etc. and are not seen yet as having sufficient fastness for practical use.

In reference to protection of dye ink images, laminating a recorded surface with a transparent film, etc. to form a protective layer has been proposed for improving water resistance or gloss. Cold lamination with a film that adheres at room temperature, hot lamination using heat to apply the lamination, and the like techniques are proposed. However, these lamination techniques have the following disadvantages. The film tends to wrinkle or entrap air bubbles upon lamination. Because the smoothness of the protective layer is easily affected by the smoothness of the recorded surface, the lamination fails to form a highly smooth protective layer on a porous ink receiving layer having a pigment ink image thereon, resulting in unsatisfactory gloss because of occurrence of gloss unevenness or the like. Considering that it is desirable for a protective layer to have as small a thickness as possible for assuring a satisfactory feeling or texture, thickness reduction achievable by these lamination techniques are limited.

Liquid lamination is also known as a lamination technique, in which a liquid film-forming composition is applied to a recorded surface and dried to form a protective film. Applied to a porous ink receiving layer, however, the film-forming composition will entrap a large number of air bubbles generated from the porous ink receiving layer, only to form a bubble-containing protective layer. Additionally, the liquid lamination is costly because of involvement of a drying step and has difficulty in forming a thin protective film because of difficulty in controlling the film thickness with a reduced amount of the coating composition.

Spray coating formulations are commercially available as a handy means for protecting a recorded image, which comprise a film-forming resin dissolved, together with an aerosolized gas, in an oil-soluble organic solvent, e.g., toluene or xylene. It is difficult to uniformly apply a coating by spraying to form a flat, thin and neat protective film. Moreover, use of the oil-soluble organic solvent is problematical for safety.

Although pigment inks that are superior to dye inks in light fastness or water fastness have been extending their use, the above-mentioned problems peculiar to pigment inks, such as poor scratch resistance and gloss unevenness, still remain unsolved. Ink jet recorded matter possessing both high image quality comparable to silver salt photographs and satisfactory image fastness (long-term storage stability) has not yet been provided.

While a number of methods for laminating an image formed mainly of dye inks with a protective layer have been proposed, there is no laminating method which is capable of improving image gloss and fastness without impairing the original texture or feeling of recorded matter.

SUMMARY OF THE INVENTION

An object (object A) of the present invention is to provide high quality ink jet recorded matter enjoying the excellent image fastness to light, water, etc. of pigments, which is excellent in resistance to scratch, gas and heat as well, hardly undergoes discoloration and fading over an extended period of time, has satisfactory gloss, texture and feeling, is free from gloss unevenness, and has a high print density; and to provide a process for producing the same.

Another object (object B) of the invention is to provide a thermal transfer sheet and an ink jet recording apparatus which enable forming, on a porous ink receiving layer having a pigment ink image thereon, a highly smooth, thin and neat protective layer having chemical and physical barrier properties without impairing the original texture or feeling of ink jet recorded matter.

A still other object (Object C) of the invention is to provide an ink jet recording medium over which a protective layer having high surface smoothness can be formed and which can provide ink jet recorded matter free from gloss unevenness, having a high gloss, and comparable to silver salt photographs in high image quality and high image fastness.

The present inventors have extensively studied seeking for ink jet recorded matter with high image quality and image fastness (long-term storage stability) comparable to silver salt photographs. As a result, they have reached a conclusion that the desired ink jet recorded matter is an ink jet recorded matter comprising: a recording medium having a porous ink receiving layer containing porous inorganic particles, wherein an image is formed of a pigment ink on the porous ink receiving layer; and a protective layer covering the image. Further studies have led them to find that a protective layer provided by using a thermal transfer sheet is capable of improving gloss and image fastness without impairing the original texture or feeling of ink jet recorded matter (finding A).

The present inventors have further made extensive investigations on ink jet recording media comprising a substrate having an ink receiving layer on one side thereof. As a result, they have found that a highly glossy protective layer having high surface smoothness and free from glass unevenness can be formed by forming an ink receiving layer on the side of a substrate which has a Bekk's surface smoothness within a specific range and by regulating the ink receiving layer surface so as to have a Bekk's surface smoothness within a specific range (finding B). Furthermore, the prevent inventors have made extensive investigations also on ink jet recording media comprising a substrate having no ink receiving layer. As a result, they have found that the protective layer can be formed by treating a substrate with a solution of a metal salt and regulating each of the front and back side surfaces thereof so as to have a Bekk's surface smoothness within a specific range (finding C).

The present invention has been completed based on finding A, and the above-described object A has been achieved by providing:

ink jet recorded matter comprising: a recording medium, which comprises a substrate having thereon a porous ink receiving layer containing porous inorganic particles; an image formed on the porous ink receiving layer with a pigment ink; and a protective layer covering the image, wherein said protective layer is formed by transferring a transfer layer provided on a heat-resistant carrier onto said image by thermal transfer; and a production process thereof.

Further, the present invention has been completed based on finding A, and the above-described object B has been achieved by providing:

a process for producing the above-described ink jet recorded matter, which comprises: an ink jet recording step of forming an image by ink jet recording with a pigment ink on an ink receiving layer of a recording medium, said recording medium comprising a substrate having thereon the ink receiving layer, said ink receiving layer containing porous inorganic particles; and a thermal transfer step of thermally transferring a transfer layer, provided on a heat-resistant carrier, onto said image; and a thermal transfer sheet; a thermal transfer apparatus; and an ink jet recording apparatus for use in the production process.

Furthermore, the invention has been completed based on finding B, and the above-described object C has been achieved by providing:

an ink jet recording medium which comprises a substrate and an ink receiving layer formed on one side of the substrate, wherein an ink jet recorded image and a protective layer covering the image are to be formed on the surface of the ink receiving layer, said one side of the substrate, before the formation of the ink receiving layer, having a Bekk's surface smoothness of 200 seconds or higher and the surface of the ink receiving layer having a Bekk's surface smoothness of 60 seconds or higher.

Furthermore, the invention has been completed based on finding C, and the above-described object C has been achieved by providing:

an ink jet recording medium which comprises a substrate, wherein an ink jet recorded image and a protective layer covering the image are to be formed on at least one side of the substrate, the substrate having been treated with a solution of a metal salt and the front and back side surfaces of the substrate each having a Bekk's surface smoothness of 200 seconds or higher.

The present invention provides high quality recorded matter which exhibits excellent image fastness, hardly undergoes discoloration and fading with time for an extended period of time, have satisfactory gloss, texture and feeling, is free from gloss unevenness, and possesses high print density.

According to the production process, thermal transfer sheet, ink jet recording apparatus and thermal transfer apparatus of the present invention, a protective layer can be formed on the surface of recorded matter to improve gloss and image fastness without spoiling the original texture and feeling of the recorded matter.

Moreover, according to the ink jet recording media of the invention, a protective layer for physically and chemically protecting an image can be formed without impairing surface smoothness. Consequently, a printed matter free from gloss unevenness, satisfactory in gloss, texture, and feeling, and comparable to silver salt photographs in high image quality and high image fastness can be provided.

BRIEF DESCRIPTION OF THE DRAWINGS

The present invention will be more particularly described with reference to the accompanying drawings, in which.

DETAILED DESCRIPTION OF THE EMBODIMENTS

Preferred embodiments of the ink jet recorded matter according to the present invention will be described with reference to FIG. 1.

Figure 1:
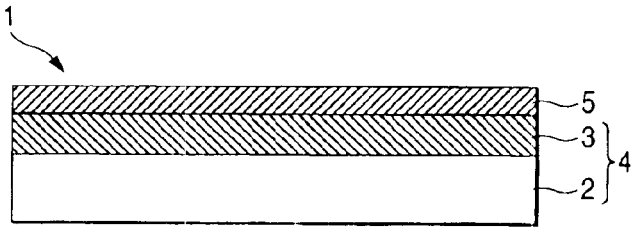
FIG. 1 is a schematic cross-section of an embodiment of the ink jet recorded matter according to the present invention.

Ink jet recorded matter 1 of the embodiment is composed, as shown in FIG. 1, of a recording medium 4 having a substrate 2 and an ink receiving layer 3 formed on the substrate 2, an image (not shown) formed on the ink receiving layer 3 with a pigment ink, and a protective layer 5 covering the image.

The substrate 2 is not particularly limited, and sheet-shaped materials commonly used as substrates of coated paper of this type may be used. Illustrative examples include various types of paper such as wood free paper, regenerated paper, and sized paper; processed paper such as art paper, coated paper, cast coated paper, resin-coated paper, and resin-impregnated paper; films or sheets of plastics such as polyethylene, polypropylene, polystyrene, and polyethylene terephthalate; nonwovens, cloths, wovens, and metallic films or plates; and composite substrates made by laminating two or more thereof. Paper and resin-coated paper (either single-sided or both-sided) are preferably used. The substrate 2 preferably has high surface smoothness to prevent air entrapment upon thermal transfer.

The ink receiving layer 3 is a porous layer containing porous inorganic particles and having numerous micropores on its surfaces and inside. The porous inorganic particles include silica pigments obtained by precipitation method, gel method, vapor phase method and the like, smectite clay, calcium carbonate, calcium sulfate, barium sulfate, titanium dioxide, kaolin, white clay, talc, magnesium silicate, calcium silicate, aluminum oxide, alumina, and pseudoboehmite. Inorganic ultrafine particulate pigments such as colloidal silica, alumina hydrate, and γ-aluminum oxide are also preferably used. The surface properties (feeling or texture) of the ink receiving layer are not particularly limited, and can be appropriately controlled to be matte finish, semigloss finish, gloss finish, or the like.

The ink receiving layer 3 can be obtained by coating the substrate 2 with a coating composition containing the porous inorganic particles and, if desired, a binder resin (e.g., polyvinyl alcohol) or various additives by means of a known coating device, such as an air knife coater, a roll coater, a blade coater, a gate roll coater or a size press, and drying the coating.

While the ink receiving layer 3 is not particularly limited as long as it contains the porous inorganic particles, preferred embodiments of the ink receiving layer 3 are as follows. The porous inorganic particles content in the ink receiving layer 3 is preferably 30 to 90% by weight, still preferably 40 to 80% by weight. The content of the binder resin, if used, is preferably 5 to 60 parts by weight, still preferably 10 to 50% by weight, per 100 parts by weight of the porous inorganic particles.

The dry thickness of the ink receiving layer 3 is preferably 10 to 50 μm, still preferably 15 to 40 μm. The coating amount in terms of dry weight is preferably 10 to 50 g/m$^2$, still preferably 15 to 40 g/m$^2$.

The ink receiving layer 3 preferably has a porosity of 20% or more as measured according to J. TAPPI No. 48-85.

The image (not shown) formed on the ink receiving layer 3 is an image formed with a pigment ink by ink jet recording. Any pigment ink formulations commonly used in ink jet recording are usable. In general, a pigment ink is an aqueous liquid in which a pigment is contained in water, and usually contains various solvents or surface active agents for modifying penetrability, moisture retention, viscosity, etc. When performing color recording, color inks of subtractive three primary colors, i.e., yellow, magenta and cyan can be used, optionally in combination with other color inks, such as black, orange and green, or with light shade inks, such as light cyan, light magenta, and photo black (middle black, light black, etc.). These combinations of inks are not particularly limited and an arbitrary combination may be employed. For example, the combinations include, as well as the three primary colors, four colors where black is added to the three primary colors, six colors where two colors, light cyan and light magenta, or orange and green, are added to the four colors, and five to eight colors where middle black and light black are added to these three to six colors.

Poor scratch resistance or gloss unevenness problem generally becomes more serious as the number of pigment ink colors increases. In particular, ink jet recorded images formed of 6 or more pigment ink colors suffer from these problems as such. The protective layer according to the present invention is especially effective on such multi-color images.

The ink jet system is to eject an ink droplet from a nozzle of a recording head. The modes thereof includes a piezoelectric system using a piezoelectric actuator and a thermal jet system using a heat generating element, but are not particularly limited herein.

The protective layer 5 covering the image (not shown) is formed by thermally transferring a transfer layer, provided on a heat-resistant carrier, onto the image. The protective layer 5 will be described below together with a preferred embodiment of a thermal transfer sheet used in the production thereof.

Figure 2:
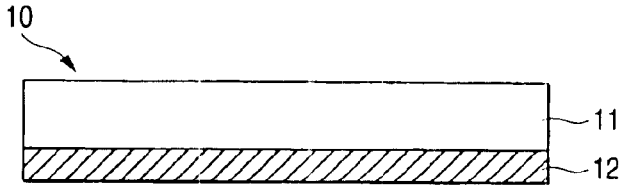
FIG. 2 is a schematic cross-section of an embodiment of the thermal transfer sheet according to the present invention.

The thermal transfer sheet 10 is composed, as shown in FIG. 2, of a heat-resistant carrier 11 and a transfer layer 12 to be transferred which is formed on one side of the carrier 11.

The heat-resistant carrier 11 can be of any material that hardly shrinks under heat so as to stably retain its shape under predetermined heat and pressure conditions applied upon thermal transfer and that is easily strippable at the stage where the protective layer 5 is formed on the ink receiving layer 3. Examples thereof include, for example, films of resins, such as polyethylene terephthalate (PET), 1,4-polycyclohexylenedimethylene terephthalate, polyethylene naphthalate (PEN), polyphenylene sulfide (PPS), polyether sulfone (PES), polystyrene, polypropylene, aramid, polycarbonate, polyvinyl alcohol, cellulose derivatives (e.g., cellophane and cellulose acetate), polyethylene, polyvinyl chloride, nylon, polyimide, and ionomers; paper, e.g., condenser paper and paraffin paper; nonwovens; and composites of paper or nonwoven and a resin film. Of these, PET is preferably used for its low cost and strippability. The carrier may be subjected to surface treatment, such as a corona discharge treatment, an antistatic treatment or a release treatment, to have controlled adhesion to the transfer layer 12. The side of the carrier on which the transfer layer 12 is to be formed may be textured to give a desired surface texture (e.g., matte, gloss, semigloss or embossed) to the transfer layer 12.

While not limiting, the heat-resistant carrier 11 preferably has a thickness of 10 to 200 μm, still preferably 15 to 80 μm, from the standpoint of cost and strippability.

The transfer layer 12 becomes the protective layer 5 through thermal transfer onto the image-recorded ink receiving layer 3. The transfer layer 12 is made of a thermoplastic resin. The thermoplastic resin is preferably selected from those capable of being thermally transferred and attached to the ink receiving layer 3 with good adhesion to provide a film that has high transparency, hardly undergoes color change by heat or light, and exhibits excellent chemical and physical barrier properties. Specifically, the thermoplastic resin is preferably selected from those capable of providing the protective layer 5 having a light transmission of 80% or higher, still preferably 90% or higher. The light transmission can be measured in accordance with JIS K6714, JIS K7105 and ASTM D1003.

It is also preferred to select the thermoplastic resin constituting the transfer layer 12 from those having a glass transition temperature (Tg) in a range of from −50° to 150° C., still preferably −20° to 120° C., to exhibit the above-described functions.

In addition to being made of thermoplastic resin having a Tg within the above-described range, the transfer layer 12 is preferably made of two or more thermoplastic resins different in Tg from each other. A combined use of two or more thermoplastic resins having different Tg's to form the transfer layer 12 of a single layer structure brings about further improvements on adhesion to the heat-resistant carrier, transferability, anti-blocking, and strength of the resultant protective layer. In a thermal transfer sheet of the type described, increased adhesion of a transfer layer to a heat-resistant carrier generally tends to result in reduced gloss of the surface of the transfer layer (the protective layer), and how to balance adhesion, transferability, and gloss has been a subject to consider. This problem can be also solved by forming the transfer layer using a combination of two or more thermoplastic resins having different Tg's as described above.

Preferred combinations thereof comprise at least one thermoplastic resin whose Tg ranges from −50° to 50° C., preferably −30° to 40° C., still preferably −20° to 30° C., (hereinafter referred to as a first resin) and at least one thermoplastic resin whose Tg ranges from 20 to 150° C., preferably 40 to 120° C., still preferably 60 to 100° C. (hereinafter referred to as a second resin).

The content of the first resin (in the case where two or more thereof are present, the total content of the first resins) in the transfer layer 12 is preferably 20% by weight or more, still preferably 20 to 50% by weight. A first resin content less than 20% may fail to produce sufficient improving effects, particularly in adhesion. The content of the second resin (in the case where two or more thereof are present, the total content of the second resins) in the transfer layer 12 is preferably 80% by weight or less, still preferably 50 to 80% by weight. A second resin content more than 80% may reduce the adhesion and the transferability.

Other preferred examples of the two or more thermoplastic resins having Tg's include combinations comprising at least one thermoplastic resin whose Tg is −20° to 50° C. and at least one thermoplastic resin whose Tg is higher than 50° C. and not higher than 120° C. In these combinations, the weight ratio of the former resin(s) and the latter resin(s) is preferably 1:9 to 9:1.

Still other examples thereof include combinations comprising at least one thermoplastic resin whose Tg is −20° to 40° C., at least one thermoplastic resin whose Tg is higher than 40° C. and not higher than 80° C., and at least one thermoplastic resin whose Tg is higher than 80° C. and not higher than 120° C. In these combinations, the contents of the resin having a Tg of −20° to 40° C., the resin having a Tg higher than 40° C. and not higher than 80° C., and the resin having a Tg higher than 80° C. and not higher than 120° C. are 10 to 60%, 10 to 80%, and 5 to 50%, each by weight, respectively.

Specific examples of the thermoplastic resins constituting the transfer layer 12 include acrylic copolymers, acrylic monomer-styrene copolymers, vinyl acetate resins, vinyl acetate copolymers, vinyl chloride-vinyl acetate copolymers, vinyl chloride-acrylic monomer copolymers, vinyl acetate-acrylic monomer copolymers, acrylic silicone copolymers, and acrylic urethane copolymers. They can be used either singly or as a combination of two or more thereof. Of these, preferred are acrylic copolymers and/or acrylic monomer-styrene copolymers for their transferability, adhesion, and the like attributes.

As the material for forming the transfer layer 12, it can be used an aqueous resin emulsion having a finely particulate thermoplastic resin(s) as a dispersoid dispersed in an aqueous dispersion medium containing water as a main solvent. The dispersoid of the resin emulsion may have a single phase structure or a dual phase structure, such as a core/shell structure. Use of resins having a core/shell structure is advantageous in, not only that the step of blending resins having different Tg's can be omitted, but also that the core/shell type resin emulsion exhibits better film forming capabilities than an emulsion prepared by mixing resins having a single phase structure. The thermoplastic resin particles, either of a single phase structure or of a dual phase structure, preferably have an average particle size of 50 to 300 $\mu$m in view of dispersion stability and film forming properties.

The above-mentioned core/shell structure refers to a structure in which two or more resins exist in separate phases, usually made of a core and a shell surrounding the core. The core/shell structure includes such configurations that the shell completely covers the core, the shell partially covers the core, part of the shell-forming resin forms domains in the core, or at least one resin layer different in composition from each of the core-forming resin and the shell-forming resin exists between the core and the shell to make up a three- or more layer-structure. Any of these layer configurations is suitably used in the invention.

In the thermoplastic resin particles having the core/shell structure, it is preferred that the Tg of the core-forming thermoplastic resin be higher than that of the shell-forming one, particularly by 30° C. or greater. Designing the Tg of the core-forming thermoplastic resin larger, both film forming properties and anti-blocking properties can be attained.

The core/shell resin emulsion can be prepared by known seeded emulsion polymerization. The core and the shell are preferably made of the above-recited thermoplastic resins. The Tg's of the core and the shell are adjusted by appropriate selecting, for example, the kinds of monomers.

The resin emulsion which is used for forming the transfer layer 12 may contain film forming assistants for controlling the minimum film forming temperature (MFT). Examples of useful film forming assistants include butyl cellosolve, butyl carbitol, butyl cellosolve acetate, butyl carbitol acetate, diethylene glycol, hexanol and 2-ethylhexanol, and these compounds can be used either singly or as a mixture of two or more thereof. The film forming assistant is preferably used in an amount of 1 to 20% by weight, still preferably 3 to 15% by weight, based on the solid content of the resin.

The material used for forming the transfer layer 12 includes, for example, commercially available resin emulsions listed below. These can be used either singly or as a mixture of two or more thereof.

Polyvinyl acetate resin emulsions, such as Nicasol series available from Nippon Carbide Industries Co., Inc., Cevian available from Daicel Kaseihin K.K., and Boncoat series available from Dainippon Ink & Chemicals, Inc.

Ethylene-vinyl acetate copolymer resin emulsions, such as Movinyl series available from Clariant Polymer Co., Ltd., Denka EVA TEX available from Denki Kagaku Kogyo K.K., Sumikaflex series available from Sumitomo Chemical Co., Ltd., and Boncoat series.

Acrylic monomer-styrene copolymer resin emulsions, such as Ricabond series available from Chuo Rika Kogyo Corp., Polymaron series available from Arakawa Chemical Industries, Ltd., and Boncoat series.

Acrylic urethane emulsions, such as Acrit series available from Taisei Chemical Industries, Ltd.

Acrylic silicone copolymer resin emulsions, such as Chaline available from Nissin Chemical Industry Co., Ltd. and Aquabrid ASi series available from Daicel Chemical Industries, Ltd.

Acrylic resin emulsions, such as Bonron series available from Mitsui Chemicals, Inc., Primal series available from Rohm & Haas, Japan, Nacrylic series available from Nippon NSC, Ltd., Vinyblan series available from Nissin Chemical Industry Co., Ltd., Acryset series available from Nippon Shokubai Co., Ltd., and Boncoat series.

Acrylic ester resin emulsions, such as Polysol series available from Showa Highpolymer Co., Ltd. and Aquabrid available from Daicel Chemical Industries, Ltd.

Carboxyl-modified styrene-butadiene copolymer emulsions, such as JSR series available from JSR.

Polychloroprene emulsions, such as Neoprene series available from Du Pont Dow Elastomers.

Water-based high molecular weight copolyester resin emulsions, such as Vylonal available from Toyobo Co., Ltd. (core/shell type).

Acrylic monomer-vinyl acetate copolymer resin emulsions and VeoVa-vinyl acetate copolymer resin emulsions, such as Boncoat series.

If desired, the transfer layer 12 can contain one or more additives, such as ultraviolet absorbers, light stabilizers, quenchers, antioxidants, waterproofing agents, antifungals, antiseptics, surface active agents, thickeners, fluidity improving agents, pH adjusting agents, defoaming agents, foam-inhibitors, leveling agents, and antistatics, in addition to the thermoplastic resins.

The thickness of the transfer layer 12 is preferably such that the protective layer 5 formed by transferring the transfer layer 12 onto the ink receiving layer 3 finally has a thickness of 2 to 20 $\mu$m, still preferably 2 to 10 $\mu$m. A protective layer thinner than 2 $\mu$m produces only insufficient effects. A protective layer thicker than 20 $\mu$m can spoil the original texture or feeling of ink jet recorded matter. Since the thickness of the transfer layer 12 is substantially unchanged through transfer, practically, the transfer layer 12 can be designed to have a thickness within the above-recited thickness range.

The transfer layer 12 may have a single layer structure made solely from a coating composition, or a multilayer structure build up by applying coating compositions having different formulations in layers followed by drying. Where it has the multilayer structure, the total thickness of the multilayer transfer layer is preferably set so as to fall within the above-recited range.

The thermal transfer sheet 10 can be produced by coating the heat-resistant carrier 11 with a coating composition, prepared by dissolving or dispersing the thermoplastic resin in an appropriate aqueous or organic solvent and, if necessary, adding various additives to the dispersion or solution (e.g., the above-described resin emulsion), by means of a known coating apparatus and then drying the coating layer to form the transfer layer 12.

The protective layer 5 is formed by thermally transferring the transfer layer 12 of the thermal transfer sheet 10 onto the ink receiving layer having an image thereon, in a conventional manner.

In some detail, the transfer layer 12 of the thermal transfer sheet 10 is superposed on the ink receiving layer 3, and pressure is applied to the stack with heat using, for example, a thermal head or a heat roll to hot press bond the transfer layer 12 to the ink receiving layer 3. After the temperature of the resulting laminate sufficiently falls, the heat-resistant carrier 11 is stripped off the transfer layer 12 to form the protective layer 5. The thermal transfer sheet 10 is designed (by properly selecting the thermoplastic resins and the other factors) so that the adhesion (A2) of the transfer layer 12 to the surface of the recording medium 4 (the surface of the ink receiving layer) or the image is larger than the adhesion (A1) of the transfer layer 12 to the heat-resistant carrier 11, each after hot press bonding the transfer layer 12 onto the image that is formed on the recording medium 4 with the pigment ink. Therefore, only the heat-resistant carrier 11 can be stripped off smoothly.

The protective layer 5 is preferably formed over the entire surface of the ink receiving layer 3 as in this embodiment, but may be formed so as to selectively cover only image-formed areas (areas including images and the surface of the ink receiving layer in the vicinities of the images).

The heating and pressing conditions for the thermal transfer may be appropriately adjusted, taking into account the thickness of the protective layer 5, etc. For example, the heating temperature (the surface temperature of a heating means, e.g., a heat roll) is preferably 40 to 120° C., still preferably 45 to 100° C., and the linear pressure is preferably 0.2 to 30 kN/m, still preferably 0.5 to 20 kN/m.

The process for producing ink jet recorded matter according to the present invention and a preferred embodiment of the ink jet recording apparatus which can be used to carry out the process will then be described with reference to the production of the ink jet recorded matter illustrated in FIG. 1 by referring to FIG. 3.

The process for producing ink jet recorded matter according to the present embodiment comprises: an ink jet recording step of forming an image by ink jet recording with a pigment ink on an ink receiving layer of a recording medium, said recording medium comprising a substrate having thereon the ink receiving layer, said ink receiving layer containing porous inorganic particles; and a thermal transfer step of thermally transferring a transfer layer, provided on a heat-resistant carrier, onto said image.

The thermal transfer step comprises: superposing a thermal transfer sheet having the transfer layer provided on the heat-resistant carrier, on the recording medium having an image formed thereon, so that the transfer layer faces the image; hot press bonding the stack obtained by the above step to give a press-bonded laminate; and stripping the heat-resistant carrier from the press bonded laminate.

Figure 3:
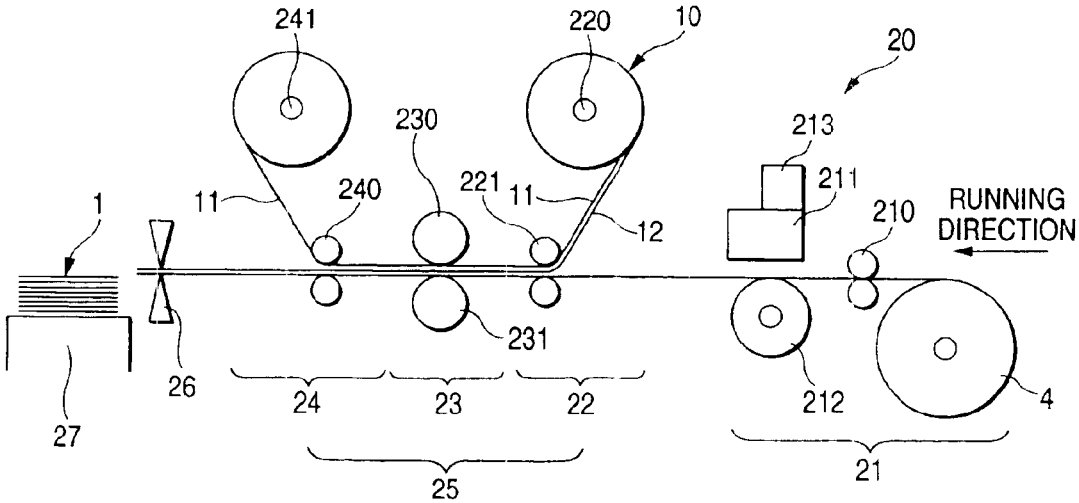
FIG. 3 is a schematic side view of an embodiment of the ink jet recording apparatus according to the present invention.

FIG. 3 is a schematic side view illustrating the substantial part of the ink jet recording apparatus 20 according to the present embodiment. The ink jet recording apparatus 20 shown in FIG. 3 has an ink jet recording means 21 for forming an ink image on a recording medium 4 (having a substrate 2 and an ink receiving layer 3 provided thereon) and a thermal transfer apparatus 25. A cutter 26 for cutting a long sheet to a unit length and a paper output tray 27 for receiving the cut sheets in a stack are provided downstream relative to the thermal transfer apparatus 2 in the running direction of the recording medium 4. The ink jet recording apparatus 20 is structurally the same as ink jet recording apparatus adapted to rolled paper of this type, except for having the thermal transfer apparatus 25.

The ink jet recording means 21 operates to unroll and feed a recording medium 4 of roll form to a recording head 211 via feed rollers 210 and eject droplets of respective color inks from the nozzles of the recording head 211 in an ink jet recording manner onto the recording surface of the recording medium 4 on a platen 212 to form an image on the recording medium 4 (i.e., ink jet recorded matter). The recording head 211 is of cartridge type integrally having an ink tank 213 and is mounted on a carriage (not shown) movably in the main scanning direction (the direction perpendicular to the running direction of the recording medium 4).

The recording head 211 may be either of a continuous ink jet system in which ink droplets are continuously ejected at a given time interval and the ejected droplets are deflected to form an image, or of on-demand ink jet system in which ink droplets are ejected in response to image data. The on-demand system is preferred, for example, because the ejection can be finely controlled and the amount of waste liquid is small. The ink ejection technique is not particularly limited and includes a system where an ink is ejected using an electromechanical conversion element, e.g., a piezoelectric actuator, and a system where an ink is ejected by heating the ink using an electrothermal conversion element, e.g., a heating element having an heating resistive body.

The thermal transfer apparatus 25 comprises: a thermal transfer sheet feed means 22 for feeding a thermal transfer sheet 10 having a transfer layer 12 provided on a heat-resistant carrier 11; a hot press bonding means 23 for hot press bonding the transfer layer 12 of the thermal transfer sheet 10 onto the image; and a stripping means 24 for stripping the heat-resistant carrier 11 of the thermal transfer sheet 10 after the hot press bonding.

The thermal transfer sheet feed means 22 comprises a feed roll 220, the thermal transfer sheet 10 wound around the feed roll 220, and an angle regulating roll 221. The feed roll 220 serves as the rotating axis of the thermal transfer sheet 10 wound in roll. The angle regulating roll 221 is disposed slightly movable upward, downward, leftward and rightward while its central axis is kept perpendicular to the running direction of the recording medium 4, so that the feed angle of the fed thermal transfer sheet 10 with respect to the recording medium 4 can be appropriately adjusted by moving the angle regulating roll 221 to an appropriate position as needed.

The hot press bonding means 23 has a pressure roll 230, which is brought in contact with the thermal transfer sheet 10, and a back-up roll 231, which is brought in contact with the recording medium 4. The gap between the pressure roll 230 and the back-up roll 231 is arbitrarily adjustable. The pressure roll 230 is a heat roll having a constitution that a heater is built within a hollow aluminum cylinder having a smooth surface, by which heat and pressure can be applied to the sheet-shaped material passing between the rolls.

The stripping means 24 comprises an angle regulating roll 240 which adjusts the peel angle of the heat-resistant carrier 11, and a take-off roll 241 to wind up the stripped heat-resistant carrier 11 therearound. Similarly to the angle regulating roll 221, the angle regulating roll 240 is disposed slightly movable upward, downward, leftward and rightward while its central axis is kept perpendicular to the running direction of the recording medium 4, so that the peel angle can be appropriately adjusted.

Upon receipt of image data from a host computer (not shown), the ink jet recording means 21 of the ink jet recording apparatus 20 thus constructed operates to unroll the recording medium 4 and eject droplets of the respective color pigment inks from the recording head 211 onto the ink receiving layer 3 according to the image data in an ink jet manner to form an ink image on the recording medium 4.

The recording medium 4 having the image formed thereon is conveyed to the thermal transfer apparatus 25, where the thermal transfer sheet feed means 22 feeds the thermal transfer sheet 10, with the transfer layer 12 facing down, onto the ink receiving layer 3 having the image formed thereon. The stack of the recording medium 4 and the thermal transfer sheet 10 is then conveyed to the hot press bonding means 23 and passed between the pressure roll 230 and the back-up roll 231 under a prescribed linear pressure at a prescribed heating temperature to carry out the heating and pressing processing. By this processing, the thermoplastic resin constituting the transfer layer 12 melts and stick fast to the ink receiving layer 3 to thereby give a press-bonded laminate (the recording medium 4 in combination with the thermal transfer sheet 10). After the temperature of the resulting laminate sufficiently falls, the heat-resistant carrier 11, which is the surface layer of the press-bonded laminate, is stripped off by the stripping means 24 to thereby give a final product, i.e., ink jet recorded matter 1. At this moment, the ink jet recorded matter 1 is in the form of long sheet, which is then cut to a predetermined length with the cutter 26. The cut sheets of the ink jet recorded matter 1 are stacked in the paper output tray 27.

The resulting ink jet recorded matter has a highly smooth, thin and neat protective layer, and hence is free from gloss unevenness and excellent in gloss, feeling, and texture. The surface properties, such as gloss, feeling, and texture, can be adjusted to give a desired finish, such as matte, semigloss, and gloss, by selecting the kind and thickness of the substrate, the thickness of the protective layer and the kind of the thermoplastic resin, and the like. The image of the ink jet recorded matter of the present invention is formed using pigments excellent in light resistance and water resistance and moreover the recorded matter has the protective layer having high chemical and physical barrier performances. Therefore, the ink jet recorded matter of the invention exhibits high image fastness, hardly undergoes discoloration and fading with time, and can be stored for a prolonged period of time.

The thickness of the protective layer for use in the invention can be made small, and there is no fear that the original feeling or texture of ink jet recorded matter is spoiled. The above-described production process of the present invention makes it feasible through simple steps to provide a highly smooth thin protective layer on the surface of a porous ink receiving layer having a pigment image formed thereon without causing air bubbles, which has been difficult with conventional lamination techniques. The thermal transfer sheet, the ink jet recording apparatus (the thermal transfer apparatus) for use in the production process are not structurally so special and can be easily produced and handled.

Other embodiments of the ink jet recording apparatus (or thermal transfer apparatus) of the invention will be illustrated with reference to FIGS. 4 through 6. The members common to the ink jet recording apparatus 20 (or thermal transfer apparatus 25) shown in FIG. 3 are given the same numerical references, and the description given for FIG. 3 applies thereto appropriately.

Figure 4:
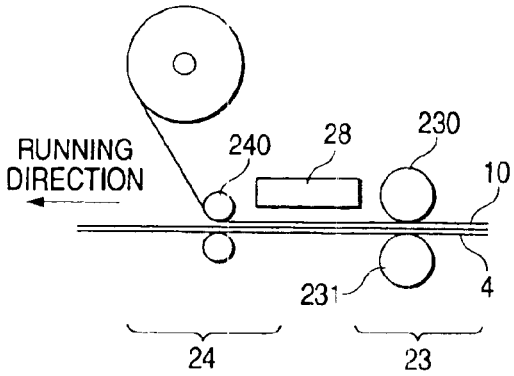
FIG. 4 schematically illustrates the substantial part (cooling means) of another embodiment of the ink jet recording apparatus according to the invention.

As shown in FIG. 4, a cooling means 28, such as a cooling fan or a plate radiator, can be disposed between the hot press bonding means 23 and the stripping means 24 (between the pressure roll 230 and the angle regulating roll 240, and above the thermal transfer sheet 10) so as to forcibly cool the press-bonded laminate (the recording medium 4 in combination with the thermal transfer sheet 10) hot press-bonded by the hot press bonding means 23. By forcibly cooling the press-bonded laminate before stripping the heat-resistant carrier after hot press bonding, the production line can be speeded up, and the gloss of the protective layer and the adhesion of the protective layer to the ink receiving layer can be improved.

Figure 5:
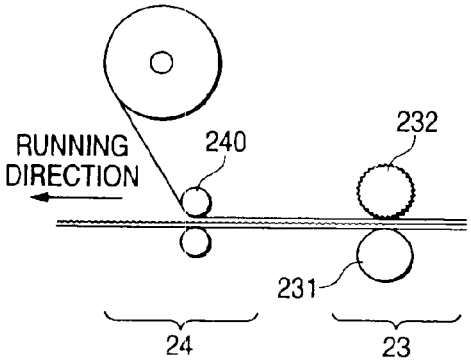
FIG. 5 schematically illustrates the substantial part (embossing mechanism) of still another embodiment of the ink jet recording apparatus according to the invention.
Figure 5:
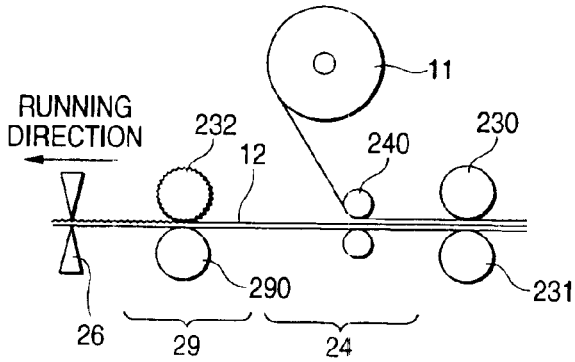

As shown in FIG. 5(*a*), the pressure roll 230 of the hot press bonding means 23 can be replaced with a embossing roll 232. The embossing roll 232 is a heat roll having a surface with a large number of bosses. The use thereof make it possible to emboss the transfer layer 12 in addition to the above-described hot press bonding of the laminate sheet. The embossing may be effected directly on the transfer layer 12, exposed by the peel off of the heat-resistant carrier 11, by disposing an embossing means 29 between the stripping means 24 and the cutter 26 as shown in FIG. 5(*b*). The embossing means 29 comprises the above-described embossing roll 232 and a back-up roll 290, and is disposed so that the sheet-shaped material to be embossed can pass through between the rolls while heated and pressed. The addition of an embossing function to the thermal transfer apparatus or ink jet recording apparatus at an appropriate position makes it possible to control the texture of the protective layer (transfer layer) with ease, making it feasible to produce ink jet recorded matter with a desired texture other than a gloss finish, such as fine-grained, matte or luster, through a single pass (i.e., a single paper feeding operation).

In the above-described ink jet recording apparatus 20, the cutter 26 is arranged downstream relative to the thermal transfer apparatus 25, in the running direction of the recording medium 4, at a certain distance therefrom. Where the ink jet recorded matter is cut to a predetermined unit length with the cutter 26 at the end of image data or at the end of quality guarantee part as in a usual manner, there is left useless non-recorded press-bonded matter between the cutter 26 and the hot press bonding means 23, which is nothing but waste of the recording medium and the thermal transfer sheet.

Figure 6:
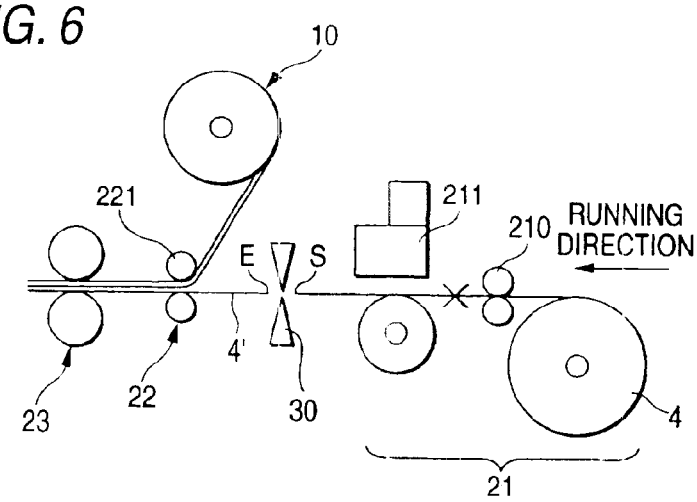
FIG. 6 schematically illustrates the substantial part (cutting means) of yet another embodiment of the ink jet recording apparatus according to the invention.

To solve this problem, a cutter 30 for cutting the recording medium 4 can be disposed between the ink jet recording means 21 and the thermal transfer sheet feed means 22 (between the recording head 211 and the angle regulating roll 221) as shown in FIG. 6, so that the recording medium 4 is cut to a unit length, before hot press bonding of the laminate of the recording medium 4 and the thermal transfer sheet 10 by hot press bonding means 23, by operating the cutter 30 at the end of image data or quality guarantee region indicated by symbol E. The cut sheet 4' thus cut off by the cutter 30 is then laminated with the transfer layer 12 by the thermal transfer apparatus 25 and discharged on the paper output tray 27 in the usual manner as described above (In this case, cutter 26 is not used basically). The starting end S of the recording medium 4 generated by the cutting with the cutter 30 is fed back to a prescribed position on standby for recording by means of feed rolls (not shown). The leading end of the unused thermal transfer sheet 10 (the part having the transfer layer 12 remaining on the heat-resistant carrier 11 not thermal transferred) is also fed back to a prescribed standby position for use in next thermal transfer operation. By providing the cutter 30, generation of useless non-recorded press-bonded matter can be prevented, and the recording medium and the thermal transfer sheet can be effectively used without waste.

The same effect can be obtained by disposing the cutter 30 at the position indicated by the cross in FIG. 6, i.e., upstream relative to the recording head 221 in the running direction of the recording medium 4 (between the paper feed rolls 210 and the recording head 211) to cut the recording medium 4 at the end of image data or quality guarantee region before ink jet recording. The cutter 30 per se as well as the cutter 26 has the same structure as well-known cutting means, either automatic or manual, adopted in this type of recording apparatus.

The present invention is not limited to the aforementioned embodiments, and various modifications can be made therein without departing from the spirit and scope thereof. For example, the ink receiving layer may be provided on, not only one side, but also both sides of the substrate 2. In the case where the ink receiving layer 3 is provided on both sides, the protective layer 5 may be provided on either both or one of the ink receiving layers.

The thermal transfer sheet of the present invention essentially requires to have the transfer layer on the heat resistant carrier and, for example, referring to FIG. 2, can have a backcoating layer on the side of the heat-resistant carrier 11 opposite to the side that contacts with the transfer layer 12. To the backcoating layer, it can be imparted a function, for example, of preventing thermal adhesion of the thermal transfer sheet to a heating device (e.g., a heat roll), or preventing blocking between the thermal transfer sheets.

The ink jet recording apparatus of the invention essentially requires to have the ink jet recording means for forming an image on a recording medium with an ink, the thermal transfer sheet feed means for feeding the thermal transfer sheet to the recording medium, and the hot press bonding means for hot press bonding the transfer layer of the thermal transfer sheet onto the image. While it is preferred for the ink jet recording apparatus to contain the stripping means as in the embodiment shown in FIG. 3, the stripping means is not essential. Where the apparatus has no stripping means, the heat-resistant carrier can be stripped off by hand.

The thermal transfer apparatus of the invention essentially require to have the thermal transfer sheet feed means for feeding the thermal transfer sheet having the transfer layer on the heat resistant carrier, and the hot press bonding means for hot press bonding the transfer layer of the thermal transfer sheet onto the image. As for the stripping means, the same as that described above for the ink jet recording apparatus applies hereto.

The specific structures of the respective means of the above-described respective apparatus and other mechanisms are not limited to those described in the foregoing embodiments, and various alterations can be made thereto. For example, though the above-described embodiments are directed to the use of the recording medium in roll form, embodiments using cut-to-size sheets, e.g., A4-sized cut sheets may be employed. In addition, the heat roll that comes into contact with the thermal transfer sheet 10 in the hot press bonding means 23 may be replaced with a thermal head, an iron, a laser or the like. Further, both a pair of rolls may be a heat roll.

Preferred embodiments of the ink jet recording media of the invention will be described below.

Embodiment 1

Embodiment 1 is an ink jet recording medium which comprises a substrate and an ink receiving layer formed on one side of the substrate and in which an ink jet recorded image and a protective layer covering the image are to be formed on the surface of the ink receiving layer.

This ink jet recording medium as embodiment 1 has features that before the formation of the ink receiving layer, said side of the substrate (the side on which the ink receiving layer is to be formed) has a Bekk's surface smoothness of 200 seconds or higher, preferably 250 seconds or higher, more preferably 300 seconds or higher, and that the surface of the ink receiving layer has a Bekk's surface smoothness of 60 seconds or higher, preferably 80 seconds or higher, more preferably 100 seconds or higher. Bekk's surface smoothness is measured in accordance with JIS P8119 (corresponding to ISO 5627). The formation of an ink receiving layer having a Bekk's surface smoothness within the specific range on the side of a substrate which has a Bekk's smoothness within the specific range makes it possible to form on the ink receiving layer a highly glossy protective layer which has high surface smoothness with no irregularities and is free from gloss unevenness.

Besides being regulated so that the Bekk's surface smoothness of the substrate surface on which the ink receiving layer is to be formed and the Bekk's surface smoothness of the ink receiving layer formed are within the respective ranges shown above, the ink jet recording medium as embodiment 1 preferably satisfies the following: after the ink receiving layer has been formed on one side of the substrate, the other side of the substrate (i.e., the side opposite to the ink receiving layer side) has a Bekk's surface smoothness of 100 seconds or higher, especially 150 seconds or higher. Such surface smoothness of the other side is advantageous for forming a highly smooth protective layer and thereby realizing a high gloss and a high-grade feeling. In general, there are cases where the Bekk's surface smoothness of a substrate decreases by about 100 seconds through the formation of an ink receiving layer thereon (i.e., through the application of a coating composition for ink receiving layer formation to the substrate and drying). Consequently, in order for that other side of the substrate to have a Bekk's surface smoothness of 100 seconds or higher after the formation of an ink receiving layer, it preferably has a Bekk's surface smoothness of 200 seconds or higher before the formation of the ink receiving layer.

A preferred technique for heightening the Bekk's surface smoothness of each side is a smoothing treatment with calendering. Calendering is a known smoothing treatment in which a calendering apparatus, e.g., a supercalender, gloss calender, or soft calender, is used to pass the work through the nip between the pressed (and optionally heated) rolls to smooth the surface(s) thereof. The substrate may be subjected to calendering either before the formation of the ink receiving layer or after the formation of the ink receiving layer. Alternatively, calendering may be conducted both before and after the formation of the ink receiving layer. A desired Bekk's surface smoothness can be obtained by suitably regulating the linear pressure, heating temperature, and other factors in the calendering. Regulation of Bekk's surface smoothness can be accomplished also by the size press method or by suitably regulating the kind, length, etc. of the fibers constituting the substrate (e.g., reducing the fiber length).

For regulating the Bekk's surface smoothness of the other side of the substrate (i.e., the side opposite to the ink receiving layer side), use may be made of a method in which a water-soluble polymer resin alone, e.g., polyvinyl alcohol (PVA), or a mixture thereof with a waterproofing agent (e.g., a thermosetting resin such as glyoxal, urea, melamine, or phenolic resin) is applied to said the other side and dried. Also usable is a method in which a resin emulsion having an average particle diameter of 1 $\mu$m or smaller is applied to said the other side and dried. These methods for regulating the Bekk's surface smoothness of that other side may be conducted in place of calendering or in combination with calendering.

Paper is especially preferred as the substrate. In particular, a raw paper for silver salt photographic papers (RC type) is preferred in that it has high adhesion to the ink receiving layer, high ink-absorbing properties, and high surface smoothness. A silver salt photographic paper is a paper obtained by resin-coating a raw paper by the extrusion laminating of polyethylene. This raw paper generally is obtained mainly from a wood pulp such as a softwood bleached kraft pulp (NBKP), hardwood bleached kraft pulp (LBKP), or softwood bleached sulfite pulp (NBSP). From the standpoint of enhancing the surface smoothness of the raw paper, the wood pulp preferably is one which has been masticated (has a small value of Canadian standard freeness) to such a degree as not to result in a decrease in the necessary strength, etc.

The thickness of the substrate is not particularly limited. From the standpoint of transferability on printers, however, the thickness thereof is preferably from 80 to 500 $\mu$m. The basis weight of the substrate is preferably from 80 to 500 g/m$^2$ from the same standpoint.

The ink receiving layer in embodiment 1 is a porous layer containing an inorganic pigment as a major component and having innumerable pores therein. The basic constitution thereof is the same as that of the ink receiving layer 3 described above. As the inorganic pigment can be used the porous inorganic particles usable in the ink receiving layer 3. Besides the inorganic pigment, a binder resin such as, e.g., polyvinyl alcohol is contained in the ink receiving layer.

The ink receiving layer preferably has a multilayer structure so as to strike a balance between ink receiving properties and surface smoothness on a high level. An especially preferred ink receiving layer is composed of two or more layers, in which the uppermost layer contains as a major component an inorganic pigment having a small average particle diameter. For example, such a preferred ink receiving layer is obtained by forming a first ink receiving layer containing amorphous silica having an average particle diameter of from 3 to 15 $\mu$m as a major component on the substrate and then forming a second ink receiving layer containing an inorganic pigment having an average particle diameter of 1 $\mu$m or smaller as a major component on the first ink receiving layer. The term "containing as a major component" as used herein means that the ingredient accounts for at least 30% by weight of each layer on a dry basis. The inorganic pigment having an average particle diameter of 1 $\mu$m or smaller preferably comprises one or more members selected from the group consisting of colloidal silica, colloidal alumina, gas-phase-process silica, and alumina hydrate.

A metal salt is preferably incorporated into the ink receiving layer from the standpoint of obtaining a high image density especially in the case of using a pigment ink. As the metal salt is used one which, upon contact with a water-based ink, has the property of destroying the dispersed state to cause coagulation. Preferred examples thereof include magnesium compounds such as magnesium nitrate, magnesium chloride, magnesium sulfate, and magnesium acetate; calcium compounds such as calcium chloride and calcium acetate; aluminum compounds such as aluminum chloride, aluminum nitrate, and aluminum sulfate; and sodium compounds such as sodium chloride, sodium sulfate, and sodium acetate.

The metal salt may be incorporated so as to be evenly dispersed in the whole ink receiving layer. Alternatively, it may be contained only in the uppermost layer of the ink receiving layer having a multilayer structure.

Modes of using the metal salt are not limited to the above-described mode in which the metal salt is incorporated in the ink receiving layer. The metal salt may be used in a mode in which a metal salt layer is formed on the ink receiving layer. This metal salt layer is obtained by dissolving or dispersing the metal salt in an appropriate solvent, e.g., water, to prepare a metal salt solution, applying the solution to the ink receiving layer, and drying the coating. In still another possible mode of using the metal salt, the substrate is treated with a solution of the metal salt. This substrate treatment with a metal salt solution can be accomplished, for example, by applying or spraying the metal salt solution on the substrate or by immersing the substrate in the metal salt solution. These modes also can be expected to produce the same effect as the mode in which the metal salt is incorporated in the ink receiving layer.

Two or more of those modes of using the metal salt may be used in combination if possible. For example, use can be made of a method in which a substrate treated with a metal salt solution is employed as the substrate and a multilayered ink receiving layer having an uppermost layer containing a metal salt is formed on the treated substrate.

The amount of the metal salt to be used is preferably from 0.1 to 20 parts by weight, more preferably from 1 to 10 parts by weight, per 100 parts by weight of the inorganic pigment (porous inorganic particles). In case where the metal salt is used in an amount smaller than the lower limit of that range, the effect of improving image density is insufficient. In case where the amount thereof exceeds the upper limit of that range, there is a possibility that resistance to thermal yellowing might decrease.

A water-soluble cationic polymer resin or a cationic emulsion may be incorporated into the ink receiving layer from the standpoint of enhancing ink-fixing properties, ink infiltration, and printing density. The content of these ingredients is preferably about from 5 to 50 parts by weight per 100 parts by weight of the inorganic pigment (porous inorganic particles).

Examples of the water-soluble cationic polymer resin include diallyldimethylammonium chloride polymers, epihalohydrin-secondary amine copolymers, diallyldimethylammonium chloride-sulfur dioxide copolymers, diallyldimethylammonium chloride-acrylamide copolymers, diallylmethylammonium salt polymers, diallylamine hydrochloride-sulfur dioxide copolymers, dimethylmethylamine hydrochloride copolymers, polyallylamines, polyethyleneimines, polyethyleneimine quaternary ammonium salt compounds, (meth)acrylamidoalkylammonium salt polymers, ionenes containing a quaternary ammonium salt group, dicyandiamide/formalin polycondensates, and dicyandiamide/diethylenetriamine polycondensates.

Examples of the cationic emulsion include the following commercial products: vinyl acetate-acrylic copolymer resin emulsions such as Rika Bond BP-316 (manufactured by Chuo Rika Kogyo Corp.); olefin resin emulsions such as Mowinyl 081F (manufactured by Clariant Polymer Co., Ltd.); alkylketene dimer emulsions such as AS211, AS261, AS262, and AS263 (manufactured by Japan PMC Corp.), BLS-5500 (manufactured by Misawa Seramic Chemical Co., Ltd.), and Sizepine SPK-903 and SPK-287 (manufactured by Arakawa Chemical Industries, Ltd.); and styrene-acrylic emulsions such as Pearlgum CS, Pearlgum CS-25S, and Pearlgum CT-61-20 (manufactured by Seiko Chemical Industries Co., Ltd.).

One or more of various additives can be incorporated into the ink receiving layer according to need. Examples of the additives include dye fixatives, fluorescent brighteners, antifungals, antiseptics, surface active agents, thickeners, pH regulators, antifoamers, waterproofing agents, hardeners, coloring dyes, coloring pigments, pigment dispersants, leveling agents, ultraviolet absorbers, and antioxidants.

The ink receiving layer can be formed on the substrate by an ordinary method. The surface smoothness of the ink receiving layer can be controlled by the casting method according to need. The casting method is a known technique for surface smoothing in which a coating composition which has been applied to a substrate and is still in a wet state or a coating composition which has been applied, dried temporarily, and then brought into a wet state again is pressed against a heating roll having a mirror surface, dried, and then peeled from the heating roll to thereby transfer the mirror surface to the coating layer. The thickness of the ink receiving layer is not particularly limited. However, regulating the ink receiving layer so as to have a thickness within the same range as that for the ink receiving layer 3 described above is effective in improving color-assuming properties and preventing particle shedding.

Embodiment 2

Embodiment 2 is an ink jet recording medium which comprises a substrate having no ink receiving layer and in which an ink jet recorded image and a protective layer covering the image are to be formed on at least one side of the substrate. As this substrate in embodiment 2 can be used the same substrate as any of those according to embodiment 1 described above. A substrate treated with a metal salt solution is especially preferred in that it is effective in obtaining a high image density. Methods for substrate treatment with the metal salt solution are as described above with regard to embodiment 1.

The ink jet recording medium as embodiment 2 has a feature that the front and back side surfaces of the substrate each have a Bekk's surface smoothness of 200 seconds or higher, preferably 250 seconds or higher, more preferably 300 seconds or higher. Regulating the Bekk's surface smoothnesses of the front and back sides of the substrate to values within the range shown above makes it possible to expect the same effects as in embodiment 1. The regulation of Bekk's surface smoothness can be accomplished by the same methods as in embodiment 1.

The ink jet recording media of the invention, which have the constitutions described above, can be used in printing in the ordinary manner. Specifically, a desired image is recorded on the ink receiving layer with one or more dye inks or pigment inks for ink jet recording. After the recording, a protective layer covering the image is formed. A suitable method for protective layer formation may be selected from the liquid laminating method in which a resin solution or resin dispersion is applied on the image, the film laminating method, and the like. The ink jet recording media of the invention are especially suitable for the method of protective layer formation with a thermal transfer sheet as in the process of the invention for producing ink jet recorded matter described above.

The invention will now be illustrated in greater detail with reference to Examples. The following Examples are presented as being exemplary of the invention and should not be construed as limiting.

<Preparation of Thermal Transfer Sheet>

Each of the following seven coating formulations was applied to one side of a PET film (having a thickness of about 38 μm) serving as a heat-resistant carrier so as to have a dry coating thickness of about 6 μm and dried to form a transfer layer, thereby thermal transfer sheets 1 to 7 being produced. The coating formulations used for the formation of the transfer layer of the respective thermal transfer sheet are as shown below. Where two or more resins having different Tg's were used to form the transfer layer, the resins are called a first resin, a second resin, . . . , for the sake of convenience.

Thermal Transfer Sheet 1:

"Acryset EX35", available from Nippon Shokubai Co., Ltd.; solid content: 43%; MFT: about 35° C.; Tg: about 30° C.

Thermal Transfer Sheet 2:

"Acryset EX64Q" available from Nippon Shokubai; solid content: 42%; MFT: about 105° C.; Tg: about 60° C.

Thermal Transfer Sheet 3:

1:1 Mixture of "Acryset EX35" and "Acryset EX64Q".

Thermal Transfer Sheet 4:

1:1:1 Mixture of "Acryset EX35", "Acryset EX64Q", and "Aquabrid 46704" (available from Daicel Chemical Industries, Ltd.; solid content: 30%; Tg: about 60° C.).

Thermal Transfer Sheet 5:

1:1 Mixture of "Boncoat 5391" (available from Dainippon Ink & Chemicals, Inc.; solid content: 50%; Tg: 50° C.) and "Boncoat EC-847" (available from Dainippon Ink & Chemicals; solid content: 54%; Tg: 20° C.).

Thermal Transfer Sheet 6:

"Acrit WEM-202U", available from Taisei Chemical Industries, Ltd.; core/shell type; solid content: 38%; core Tg: 8° C.; shell Tg: 40° C.

Thermal Transfer Sheet 7:

"Acrit WEM-030U" available from Taisei Chemical; core/shell type; solid content: 38%; core Tg: 77° C.; shell Tg: 50° C.

The anti-blocking property and adhesion of the transfer layer were evaluated as follows. The results obtained are shown in Table 1 below.

<Evaluation of Anti-Blocking Property>

For each thermal transfer sheets, two A4-sized sheets were prepared and stacked with their transfer layers in contact and allowed to stand under a load of 0.5 kg/cm$^2$ at room temperature of 50° C. and 60% RH. After 12 hour standing, the two sheets were peeled apart. The peelability was evaluated in accordance with the following criteria.

Evaluation Criteria:

A . . . Easily peelable by hand. Very good anti-blocking.

B . . . Easily peelable by hand but with a sound made upon peeling. Good anti-blocking.

C . . . Some force needed for peeling, but acceptable for practical use.

D . . . Unpeelable by hand. Unacceptable for practical use.

<Evaluation of Adhesion of Transfer Layer>

Cello Tape® was stuck to the transfer layer surface of the respective thermal transfer sheet. After applying a load of 500 g/cm$^2$, the adhesive tape was quickly stripped off. The adhesion of the transfer layer to the carrier was evaluated in accordance with the following criteria.

Evaluation Criteria:

A . . . No influence of the adhesive tape observed. Very good adhesion to the carrier.

B . . . Almost no influence of the adhesive tape observed but with sign of the transfer layer separating from the carrier in some part. Satisfactory adhesion to the carrier.

C . . . Part of the transfer layer separated from the carrier. Acceptable for practical use.

D . . . Considerable separation of the transfer layer occurred. Unacceptable for practical use.

<Evaluation of Film-Forming Properties>

The transfer layer of the thermal transfer sheet was observed with the naked eye and graded "A" for the here no cracks observed, indicating very good film-forming properties of the coating composition, "B" for the case where cracks observed in some part but to an acceptable degree, or "C" for the case where unacceptably many cracks for practical use. From the results shown in Table 1, it can be seen that core/shell type resin ions are very effective to form the transfer layer.

TABLE 1

| | Transfer Layer | | | | | | Film- |
|---|---|---|---|---|---|---|---|
| Transfer Sheet | 1st Resin Tg (° C.) | 2nd Resin Tg (° C.) | 3rd Resin Tg (° C.) | 1st:2nd: 3rd Resins | Anti-blocking | Adhesion | forming Properties |
| 1 | 30 | — | — | — | C | A | — |
| 2 | 60 | — | — | — | A | C | — |
| 3 | 30 | 60 | — | 1:1 | A | B | — |
| 4 | 30 | 60 | 60 | 1:1:1 | A | A | — |
| 5 | 50 | 20 | — | 1:1 | B | A | B |
| 6 | 8/40[1)] | — | — | core/shell | B | A | A |
| 7 | 77/50[1)] | — | — | core/shell | A | A | A |

[1)]Core Tg/shell Tg

<Preparation of Ink Jet Recorded Matter>

Commercially available MC matte paper (KA450MM available from Seiko Epson Corp.; porosity: about 30%) was printed (on its ink receiving layer) by an ink jet printer (MC2000 available from Seiko Epson) with pigment inks, yellow (Y), magenta (M), cyan (C), red (R), green (G), blue (B) and black (Bk), to give color patches having an optical density (OD) of 1.0 and a maximum density for each color. Thus, ink jet recorded matter 1 was obtained.

Commercially available PM photo paper (available from Seiko Epson; porosity: about 75%) was printed on its ink receiving layer in the same manner as described above to give color patches. Thus, ink jet recorded matter 2 was obtained.

EXAMPLE A1

Using thermal transfer sheet 4, thermal transfer of the transfer layer was carried out with respect to each of ink jet recorded matter 1 and 2. Specifically, the thermal transfer sheet and the ink jet recorded matter were superposed so that the transfer layer of the thermal transfer sheet came to contact with the ink receiving layer of the recorded matter, and then were subjected to hot press treatment at a heating temperature of 100° C. and under a linear pressure of 8 kN/m by passing through between a pair of rolls, in which the roll to be brought into contact with the thermal transfer sheet was a heat roll, at a speed of 10 mm/sec, to press bond the transfer layer to the entire surface of the ink receiving layer. Thus, two kinds of press-bonded laminates were obtained and these laminates were designated as samples of Example A1.

EXAMPLE A2

Two kinds of press-bonded laminates (samples) were prepared in the same manner as in Example A1, except that the hot press bonded laminate of the ink jet recorded matter and the thermal transfer sheet was cooled with a cooling fan after the hot press treatment. These laminates were designated as samples of Example A2.

EXAMPLE A3

Two kinds of press-bonded laminates (samples) were prepared in the same manner as in Example A1, except that thermal transfer sheet 3 was used in place of thermal transfer sheet 4. These laminates were designated as samples of Example A3.

EXAMPLE A4

Two kinds of press-bonded laminates (samples) were prepared in the same manner as in Example A1, except that thermal transfer sheet 2 was used in place of thermal transfer sheet 4. These laminates were designated as samples of Example A4.

EXAMPLE A5

Two kinds of press-bonded laminates (samples) were prepared in the same manner as in Example A1, except that thermal transfer sheet 1 was used in place of thermal transfer sheet 4. These laminates were designated as samples of Example A5.

EXAMPLE A6

Two kinds of press-bonded laminates (samples) were prepared in the same manner as in Example A1, except that thermal transfer sheet 5 was used in place of thermal transfer sheet 4. These laminates were designated as samples of Example A6.

EXAMPLE A7

Two kinds of press-bonded laminates (samples) were prepared in the same manner as in Example A1, except that thermal transfer sheet 6 was used in place of thermal transfer sheet 4. These laminates were designated as samples of Example A7.

EXAMPLE A8

Two kinds of press-bonded laminates (samples) were prepared in the same manner as in Example A1, except that thermal transfer sheet 7 was used in place of thermal transfer sheet 4. These laminates were designated as samples of Example A8.

<Evaluation of Carrier Strippability>

Only the heat-resistant carrier was stripped off each sample (press-bonded laminate of recorded matter 1 or 2 and the thermal transfer sheet) of Examples A1 to A8 and the strippability upon peeling was evaluated. The peeling was carried out at a peel angle (the angle between the heat-resistant carrier and the press-bonded transfer layer) of 90° and at a peeling speed of 10 mm/sec. In addition, the surface condition of the resulting protective layer-provided ink jet recorded matter thus obtained by the peeling was observed with the naked eyes. The protective layer of each protective layer-provided ink jet recorded matter had a thickness of about 6 $\mu$m. These aspects were totally taken into account and evaluation was made based on the following criteria. The evaluation results are shown in Table 2 below.

Evaluation Criteria:

A . . . Only the carrier was strippable easily and uniformly to form a neat protective layer.

B . . . The carrier was slightly hard to strip off but successful to form a neat protective layer. Acceptable for practical use.

C . . . It was impossible to strip only the carrier off the transfer layer. As a result, some part of the protective layer was missing.

The protective layer-provided ink jet recorded matter of Examples A1 to A8 obtained in the evaluation of the carrier strippability described above were evaluated for gloss, gloss uniformity, scratch resistance, gas resistance, heat resistance, and adhesion of the protective layer, in accordance with the methods described below. For comparison, the above-described ink jet recorded matter 1 (MC matte paper having color patches printed thereon with no protective layer) and ink jet recorded matter 2 (PM photo paper having color patches printed thereon with no protective layer) were used as Comparative Example A1 and Comparative Example A2, respectively. The results obtained are shown in Table 2.

<Evaluation of Gloss>

A 60° specular gloss (specified in JIS Z 8741) of the non-image area of each sample (having MC matte paper as a base) was measured with a glossimeter "PG-1" supplied by Nippon Denshoku Industries Co., Ltd. A higher 60° specular gloss value indicates higher gloss.

<Evaluation of Gloss Uniformity>

For each sample (having PM photo paper as a base), 60° specular gloss differences were determined among colors of Y, M, C, R, G, B and Bk and between at an OD value of 1 and at the maximum density, and evaluated in accordance with the following evaluation criteria.

Evaluation Criteria:

A . . . The difference was less than 5. Satisfactory gloss uniformity.

B . . . The difference was 5 or more and less than 10. Acceptable for practical use.

C . . . The difference was 10 or more. Unacceptable for practical use.

<Evaluation of Scratch Resistance>

On the surface of each sample (having PM photo paper as a base), an eraser (rubber having a width of 20 mm) was placed at an angle of 60°, and the sample was rubbed 10 reciprocating strokes with the eraser while applying a 1 kg load applied onto the eraser. The rubbed surface was observed with the naked eyes and evaluated in accordance with the following criteria.

Evaluation Criteria:

A . . . No scratches nor peeling occurred. Satisfactory scratch resistance.

B . . . Scratches occurred. Acceptable for practical use.

C . . . Peeling occurred. Unacceptable for practical use.

<Evaluation of Gas Resistance>

Each sample (having PM photo paper as a base) was put into a glass container having a gas inlet and a gas outlet. Ozone gas generated from an ozone generator was introduced into the glass container at a rate of 10 ppm for consecutive 100 hours. The color difference of the cyan printed area of each sample between before and after the gas treatment was determined using a colorimeter and evaluated in accordance with the following criteria.

Evaluation Criteria:

A. . . The color difference was smaller than 5. Satisfactory gas resistance.

B . . . The color difference was 5 or greater and smaller than 15. No problem in gas resistance.

C . . . The color difference was 15 or greater and smaller than 20, corresponding to limit for practical use.

D . . . The color difference was 20 or greater. Unacceptable for practical use.

<Evaluation of Heat Resistance>

Each sample (having MC matte paper as a base) was put into a thermo-hygrostat (PR-3KT, supplied by Tabai Espec Corp.), and left to stand at 70° C. and 60% RH for 1 month. Thereafter, the color difference (average value) on the white background of each sample between before and after the standing was determined using a colorimeter, and evaluated in accordance with the following criteria.

Evaluation Criteria:

A. . . The color difference was smaller than 5. Satisfactory heat resistance.

B . . . The color difference was 5 or greater and smaller than 15, corresponding to limit for practical use.

C . . . The color difference was 15 or greater. Unacceptable for practical use.

<Evaluation of Adhesion of Protective Layer>

Cello Tape® was stuck to the protective layer surface of each sample (having PM photo paper as a base). After applying a load of 500 g/cm$^2$, the adhesive tape was quickly stripped off. The adhesion of the protective layer was evaluated in accordance with the following criteria.

Evaluation Criteria:

A . . . No change observed. Satisfactory adhesion.

B . . . The protective layer peeled. Unacceptable for practical use.

TABLE 2

| | Thermal Transfer Sheet | Strippability | Gloss | Gloss Uniformity | Scratch Resistance | Gas Resistance | Heat Resistance | Adhesion |
|---|---|---|---|---|---|---|---|---|
| Ex. A1 | 4 | B | 50 | A | A | A | A | A |
| Ex. A2 | 4 | A | 50 | A | A | A | A | A |
| Ex. A3 | 3 | B | 50 | A | A | A | A | A |
| Ex. A4 | 2 | B | 50 | A | A | A | A | A |
| Ex. A5 | 1 | B | 50 | A | A | A | A | A |
| Ex. A6 | 5 | B | 50 | A | A | A | A | A |
| Ex. A7 | 6 | B | 55 | A | A | A | A | A |
| Ex. A8 | 7 | A | 55 | A | A | A | A | A |
| Comp. Ex. A1 | — | — | 8 | C | C | C | C | — |
| Comp. Ex. A2 | — | — | 35 | A | C | C | B | — |

EXAMPLES B1 TO B3 AND COMPARATIVE EXAMPLES B1 TO B3

A 1:1 mixture of a hardwood bleached kraft pulp (LBKP) and a softwood bleached sulfite pulp (NBSP) was masticated to such a degree as to result in a Canadian standard freeness of 300 mL to prepare a pulp slurry. Thereto were added as sizing agents polyacrylamide and cationized starch in amounts of 1% by weight and 2% by weight, respectively, based on the pulps. This mixture was diluted with water to obtain a 1% pulp slurry. This pulp slurry was fed as a feed material to a wire paper machine to produce a sheet of paper having a basis weight of 200 g/m$^2$ and a thickness of from 200 to 230 $\mu$m to be used as a substrate. Samples of the substrate thus obtained were calendered with a heated calender under different conditions so that the front and back side surfaces of each sample came to have the respective values of Bekk's surface smoothness (allowance, ±30 seconds) shown in Table 3 given later. In these Examples, measurements of the Bekk's surface smoothnesses were made with Bekk's surface smoothness tester PU-902, manufactured by Tester Sangyo K.K.

Ink receiving layer 1 and ink receiving layer 2 respectively having the compositions shown below were formed successively on the front side of each calendered substrate by coating in amounts of 12 g/m$^2$ and 8 g/m$^2$, respectively, on a dry basis to form an ink receiving layer of a two-layer structure. The resultant samples were calendered with a supercalender under different conditions so that the surface of the ink receiving layer in each sample came to have the value of Bekk's surface smoothness shown in Table 3. Thus, ink jet recording media were produced.

Ink Receiving Layer 1

Synthetic silica (trade name "Carplex BS-304N"; average particle diameter, 7–11 $\mu$m; manufactured by Shionogi & Co., Ltd.), 50% by weight Synthetic silica (trade name "Rheorosil QS40", manufactured by Tokuyama Corp.), 10% by weight Polyvinyl alcohol (trade name "Gohsenol T-330", manufactured by The Nippon Synthetic Chemical Industry Co., Ltd.), 20% by weight Cationic polymer (trade name "Sumirez Resin 1001", manufactured by Sumitomo Chemical Co., Ltd.), 10% by weight Ethylene-vinyl acetate emulsion (trade name "Sumikaflex 510", manufactured by Sumitomo Chemical Co., Ltd.), 10% by weight Ink Receiving Layer 2

Synthetic silica (trade name "Finesil X37-B"; average particle diameter, 3.7 μm; manufactured by Tokuyama Corp.), 30% by weight Colloidal silica (trade name "Cataloid SI-50"; average particle diameter, 19–30 nm; manufactured by Catalyst & Chemicals Industries Co., Ltd.), 30% by weight Polyvinyl alcohol (trade name "PVA117", manufactured by Kuraray Co., Ltd.), 25% by weight Cationic polymer (trade name "Sumirez Resin 1001", manufactured by Sumitomo Chemical Co., Ltd.), 10% by weight Magnesium sulfate, 5% by weight Using an ink jet printer (trade name "MC2000") capable of printing with pigment inks of six colors (Y, M, C, Lm, Lc, and Bk), the thus-obtained ink jet printing media each were printed in yellow (Y), magenta (M), cyan (C), red (R), green (G), blue (B), and black (Bk) to give color patches having an OD (optical density) of 1.0 and a maximum density for each color. Thus, recorded matters were obtained.

Furthermore, a mixture of an acrylic emulsion (trade name, "Bonron S1320"; solid concentration, 40%; manufactured by Mitsui Chemicals Inc.) and a surfactant (trade name "Surfionl TG", manufactured by Nisshin Chemical Industry Co., Ltd.) (surfactant content in the mixture: 0.05% by weight) was separately applied to a PET film (thickness: 38 μm) as a carrier in a thickness of 10 μm on a dry basis. The coating was dried to produce a thermal transfer sheet.

This thermal transfer sheet was superposed on each recorded matter in such a manner that the transfer layer of the thermal transfer sheet came into contact with the ink receiving layer of the recorded matter. The resultant assemblage was passed through the nip between a pair of heated rolls to heat and press the assemblage at a heating temperature of 70° C. and a linear pressure of 100 N/cm. Thereafter, the carrier was peeled off to obtain a recorded matter having a transparent protective layer with a thickness of 10 μm. Thus, recorded matter samples of Examples B1 to B3 and Comparative Examples B1 to B3 were obtained.

EXAMPLES B4 TO B6

Recorded matters having a transparent protective layer with a thickness of 10 μm were obtained in the same manner as in Example B1, except that the front side of the substrate (paper) which had not been calendered was coated with 5% aqueous magnesium sulfate solution in an amount of 0.1 $g/m^2$ on a dry basis. Thus, samples of Examples B4 to B6 were obtained. Conditions for the calendering were suitably regulated so that each side came to have the value of Bekk's surface smoothness shown in Table 3.

EXAMPLE B7

A recorded matter having a transparent protective layer with a thickness of 10 μm was obtained in the same manner as in Example B1, except that a 6:3:1 mixture of a special modified PVA (trade name "Gohsefimer Z200"), a vinyl acetate emulsion, and a water-soluble melamine resin was applied to the back side (the side opposite to the ink receiving layer) of the substrate to form a coat layer having a thickness of 2 μm. Thus, a sample of Example B7 was obtained.

COMPARATIVE EXAMPLE B4

A recorded matter having the same constitution as the recorded matter of Example B1 except that it had no protective layer was designated as a sample of Comparative Example B4.

The recorded matters of Examples B1 to B7 and Comparative Examples B1 to B4 were evaluated for surface appearance, gloss uniformity, scratch resistance, gas resistance, and recording side strength by the following methods. The results obtained are shown in Table 3.

<Evaluation of Surface Appearance>

The front side (recording side) of each recorded matter was examined with the naked eye. The samples which were equal in surface smoothness to silver salt photographs are indicated by A (satisfactory surface appearance), those which had small irregularities are indicated by B (acceptable for practical use), and those which had large irregularities are indicated by C (unacceptable for practical use).

<Evaluation of Gloss Uniformity>

For each sample, the 75° specular gloss of a white area and the average of the 75° specular glosses of Y, M, C, R, G, B, and Bk areas were determined. Gloss uniformity was evaluated in terms of the difference between the two gloss values based on the following criteria. 75° specular gloss was measured in accordance with JIS Z8741 or P8142.

Evaluation Criteria:

A . . . The difference was less than 5. Satisfactory gloss uniformity.

B . . . The difference was 5 or more and less than 15. Acceptable for practical use.

C . . . The difference was 15 or more and less than 20. Acceptable for practical use with difficulty.

D . . . The difference was 20 or more. Unacceptable for practical use.

<Evaluation of Scratch Resistance>

An eraser (rubber having a width of 20 mm) was placed at an angle of 60° on the surface of each recorded matter, and the sample was rubbed with ten reciprocating strokes of the eraser while applying a 1-kg load on the eraser. The surface rubbed was examined with the naked eye and evaluated in accordance with the following criteria.

Evaluation Criteria:

A . . . Neither scratches nor peeling occurred. Satisfactory scratch resistance.

B . . . Scratches occurred. Acceptable for practical use with difficulty.

C . . . Peeling occurred. Unacceptable for practical use.

<Evaluation of Gas Resistance>

Each recorded matter was put into a glass container having a gas inlet and a gas outlet. Ozone gas generated from an ozone generator was introduced into the glass container at a rate of 1 ppm for consecutive 100 hours to conduct a gas treatment. The color difference of the black printed area of each printed matter between before and after the gas treatment was determined using a colorimeter and evaluated in accordance with the following criteria.

Evaluation Criteria:

A . . . The color difference was smaller than 5. Satisfactory gas resistance.

B . . . The color difference was 5 or greater and smaller than 15. Acceptable for practical use.

C . . . The color difference was 15 or greater and smaller than 20. Acceptable for practical use with difficulty.

D . . . The color difference was 20 or greater. Unacceptable for practical use.

<Evaluation of Recording Side Strength>

Cello Tape®, manufactured by Sekisui Chemical Co., Ltd., was stuck to the front side (recording side) of each recorded matter and then stripped off. Thereafter, the state of the recording side was examined with the naked eye. The samples in which the protective layer remained completely unpeeled are indicated by A (excellent recording side strength), those in which the protective layer slightly peeled off are indicated by B (acceptable for practical use with difficulty), and those in which peeling occurred in the printed areas are indicated by C (unacceptable for practical use).

TABLE 3

| | Bekk's surface smoothness (s) | | | | | | | |
|---|---|---|---|---|---|---|---|---|
| | Substrate front side | Ink receiving layer | Substrate back side[1)] | Surface appearance | Gloss uniformity | Scratch resistance | Gas resistance | Recording side strength |
| Ex. B1 | 200 | 60 | 100 | B | B | A | A | A |
| Ex. B2 | 250 | 80 | 150 | A | A | A | A | A |
| Ex. B3 | 300 | 90 | 200 | A | A | A | A | A |
| Ex. B4 | 200 | 150 | 150 | B | B | A | A | A |
| Ex. B5 | 250 | 200 | 200 | A | A | A | A | A |
| Ex. B6 | 300 | 250 | 250 | A | A | A | A | A |
| Ex. B7 | 200 | 60 | 150 | A | A | A | A | A |
| Comp. Ex. B1 | 100 | 50 | 50 | C | C | A | A | A |
| Comp. Ex. B2 | 250 | 50 | 80 | C | B | A | A | A |
| Comp. Ex. B3 | 100 | 80 | 50 | C | B | A | A | A |
| Comp. Ex. B4 | 200 | 60 | 100 | B | C | C | C | C |

[1)]Bekk's surface smoothness of the substrate back side after ink receiving layer formation on the substrate front side.

The invention having being thus described, it will be obvious that the same may be varied in many ways. Such variations should not be regarded as a departure from the spirit and scope of the invention, and all such modifications as would be obvious to one skilled in the art are intended to be included within the scope of the following claims.

What is claimed is:

1. Ink jet recorded matter comprising: a recording medium, which comprises a substrate having thereon a porous ink receiving layer containing porous inorganic particles; an image formed on the porous ink receiving layer with a pigment ink; and a protective layer covering the image, wherein said protective layer is formed by transferring a transfer layer provided on a heat-resistant carrier onto said image by thermal transfer.

2. The ink jet recorded matter acccording to claim 1, wherein said protective layer has a thickness of 2 to 20 $\mu$m.

3. The ink jet recorded matter according to claim 1, wherein said protective layer has a light transmission of 80% or higher.

4. The ink jet recorded matter according to claim 1, wherein said protective layer covers the entire surface of said ink receiving layer.

5. The ink jet recorded matter according to claim 1, wherein said image is formed of pigment inks of six or more colors.

6. A process for producing ink jet recorded matter to claim 1, which comprises:

an ink jet recording step of forming an image by ink jet recording with a pigment ink on an ink receiving layer of a recording medium, said recording medium comprising a substrate having thereon the ink receiving layer, said ink receiving layer containing porous inorganic particles; and a thermal transfer step of thermally transferring a transfer layer provided on a heat-resistant carrier, onto said image.

7. The process for producing ink jet recorded matter according to claim 6, wherein said image is formed using pigment inks of six or more colors.

8. A thermal transfer sheet for use in a process for producing ink jet recorded matter according to claim 6, comprising a heat-resistant cam and a transfer layer provided on said carrier.

9. The thermal transfer sheet according to claim 8, wherein said transfer layer is made of two or more thermoplastic resins having different glass transition temperatures.

10. The thermal transfer sheet acccording to claim 9, wherein said thermoplastic resins comprise at least one thermoplastic resin having glass transition temperature of −50° to 50° C. and at least one thermoplastic resin having a glass transition temperature of 20 to 150° C.

11. The thermal transfer sheet according to claim 9, wherein said thermoplastic resins comprise at least one thermoplastic resin having glass transition temperature of −20° to 50° C. and at least one thermoplastic resin having a glass transition temperature of higher than 50° C. and not higher than 120° C.

12. The thermal transfer sheet according to claim 8, wherein said transfer layer is made from an aqueous resin emulsion containing, as dispersoids, thermoplastic resin particles having a core/shell structure.

13. The thermal transfer sheet according to claim 12, wherein the thermoplastic resin constituting the core of said thermoplastic resin particles has a higher glass transition temperature than that resin constituting the shell.

14. The thermal transfer sheet according to claim 8, wherein the adhesion (A2) of said transfer layer to the surface of the recording medium or the image is larger than the adhesion (A1) of said transfer layer to said heat-resistant carrier, each after hot press bonding said transfer layer of the thermal transfer sheet onto the image formed on a recording medium with a pigment ink.

15. The thermal transfer sheet according to claim 8, wherein said heat-resistant carrier has a thickness of 10 to 200 $\mu$m, and said transfer layer has a thickness of 2 to 20 $\mu$m.

16. An ink jet recording apparatus for producing ink jet recorded matter according to claim 6, which comprises an ink jet recording means for forming an ink image on a recording medium, a thermal transfer sheet feed means for feeding a thermal transfer sheet having a heat-resistant carrier and a transfer layer provided on said heat-resistant carrier, a hot press bonding means for hot press bonding said transfer layer to said ink image, and a stripping means for stripping of said heat-resistant carrier after the hot press bonding.

17. The ink jet recording apparatus according to claim 16, which further comprises a cooling means for cooling a hot press bonded laminate, located between said hot press bonding means and said stripping means.

18. The ink jet recording apparatus according to claim 16, wherein said hot press bonding means has a surface-textured roll capable of hot press bonding and embossing.

19. The ink jet recording apparatus according to claim 16, which further comprises an embossing means.

20. The ink jet recording apparatus according to claim 16, wherein said ink jet recording means has a recording head which ejects ink droplets, and said ink jet recording apparatus further comprises a cutter for cutting the recording medium, said cutter being disposed between said recording head and said thermal transfer sheet feed means or at a position upstream of said recording head along the running direction of the recording medium so that a long recording medium is cut to a unit length before the hot press bonding.

21. A thermal transfer apparatus for use in the process for producing ink jet recorded matter according to claim 6, which comprises a thermal transfer sheet feed means for feeding a thermal transfer sheet having a heat-resistant carrier and a transfer layer provided on said carrier, a hot press bonding means for hot press bonding said transfer layer of said thermal transfer sheet to an image, and a stripping means for stripping off said carrier of said thermal transfer sheet after the hot press bonding.

22. The thermal transfer apparatus according to claim 21, which further comprises a cooling means for cooling a hot press bonded laminate, said cooling means being disposed between said hot press bonding means and said stripping means.

23. The thermal transfer apparatus according to claim 21, wherein said hot press bonding means has a surface-textured roll capable of hot press bonding and embossing.

24. The thermal transfer apparatus according to claim 21, which further comprises an embossing means.

25. An ink jet recording medium which comprises a substrate and an ink receiving layer formed on one side of the substrate, wherein an ink jet recorded image and a protective layer covering the image are formable on a surface of the ink receiving layer, said side of the substrate, before the formation of the ink receiving layer, having a Bekk's surface smoothness of 200 seconds or higher, and the surface of the ink receiving layer having a Bekk's surface smoothness of 60 seconds or higher, wherein the ink receiving layer comprises at least two layers, including an uppermost layer containing an inorganic pigment having an average particle diameter of 1 mm or smaller as a major component.

26. The ink jet recording medium according to claim 25, wherein after the ink receiving layer has been formed on one side of the substrate, the other side of the substrate has a Bekk's surface smoothness of 100 seconds or higher.

27. The ink jet recording medium according to claim 25, wherein the uppermost layer contains a metal salt.

28. The ink jet recording medium according to claim 25, wherein the substrate has been treated with a solution of a metal salt.

29. An ink jet recording medium which comprises a substrate and an ink receiving layer formed on one side of the substrate, wherein an ink jet recorded image and a protective layer covering the image are formable on the surface of a ink receiving layer, said side of the substrate, before the formation of the ink receiving layer, having a Bekk's surface smoothness of 200 seconds or higher, and the surface of the ink receiving layer having a Bekk's surface smoothness of 60 seconds or higher, the ink receiving layer containing an inorganic pigment as a major component.

30. The ink jet recording medium according to claim 29, wherein after the ink receiving layer has been formed on one side of the substrate, the other side of the substrate has a Bekk's surface smoothness of 100 seconds or higher.

31. The ink jet recording medium according to claim 30, wherein the one side of the substrate has a Bekk's surface smoothness of 200–300 seconds and the surface of the ink receiving layer has a Bekk's surface smoothness of 60–250 seconds.

32. The ink jet recording medium according to claim 29, wherein the ink receiving layer comprises at least two layers, including an uppermost layer containing the inorganic pigment, the inorganic pigment having an average particle diameter of 1 mm or smaller.

33. The ink jet recording medium according to claim 32, wherein the uppermost layer contains a metal salt.

34. The ink jet recording medium acccording to claim 29, wherein the substrate has been treated with a solution of a metal salt.

* * * * *